US009926830B2

(12) United States Patent
Warey et al.

(10) Patent No.: US 9,926,830 B2
(45) Date of Patent: Mar. 27, 2018

(54) HIGH EFFICIENCY TWO-STROKE ENGINE

(71) Applicant: GM GLOBAL TECHNOLOGY OPERATIONS LLC, Detroit, MI (US)

(72) Inventors: Alok Warey, Novi, MI (US); Michael A. Potter, Grass Lake, MI (US); Venkatesh Gopalakrishnan, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 95 days.

(21) Appl. No.: 14/997,619

(22) Filed: Jan. 18, 2016

(65) Prior Publication Data

US 2016/0215692 A1 Jul. 28, 2016

Related U.S. Application Data

(60) Provisional application No. 62/106,335, filed on Jan. 22, 2015.

(51) Int. Cl.

| | |
|---|---|
| ***F01P 3/16*** | (2006.01) |
| ***F01P 3/02*** | (2006.01) |
| ***F02B 25/00*** | (2006.01) |
| *F02F 1/42* | (2006.01) |
| *F02F 1/24* | (2006.01) |
| *F02B 75/02* | (2006.01) |

(52) U.S. Cl.

CPC ..... *F01P 3/16* (2013.01); *F01P 3/02* (2013.01); *F02B 25/00* (2013.01); *F02B 2075/025* (2013.01); *F02B 2710/03* (2013.01); *F02F 1/425* (2013.01); *F02F 1/4214* (2013.01); *F02F 2001/249* (2013.01)

(58) Field of Classification Search

CPC ..... F02F 1/425; F02F 1/4214; F02F 2001/249
USPC ..... 123/41.82 R
See application file for complete search history.

(56) References Cited

U.S. PATENT DOCUMENTS

2007/0204747 A1 9/2007 Aoyama et al.
2008/0250923 A1 10/2008 Mitsui et al.
(Continued)

FOREIGN PATENT DOCUMENTS

CN 2649790 Y 10/2004
CN 101449046 A 6/2009
DE 102005018303 * 11/2006 ..... F02F 1/40

*Primary Examiner* — Jacob Amick
*Assistant Examiner* — Charles Brauch
(74) *Attorney, Agent, or Firm* — Quinn IP Law

(57) ABSTRACT

A two-stroke engine includes a crankcase defining a cylinder bore, a piston moveably disposed within the cylinder bore, and a cylinder head that covers the cylinder bore. A wall surface of the cylinder bore, a piston combustion surface of the piston, and a head combustion surface of the cylinder head, cooperate to define a combustion chamber for combusting a fuel therein. A thermal conductivity reducing mechanism is disposed in thermal connectivity with at least one of the crankcase, the piston, and the cylinder head for reducing heat transfer from combusted fuel within the combustion chamber to at least one of the crankcase, the piston, and the cylinder head. The thermal conductivity reducing mechanism may include a layer of low conductivity material coating one of the surfaces defining the combustion chamber, or a void in the cylinder head and/or the crankcase adjacent the combustion chamber.

17 Claims, 2 Drawing Sheets

(56) References Cited

U.S. PATENT DOCUMENTS

| | | | | |
|---|---|---|---|---|
| 2009/0071434 | A1* | 3/2009 | MacMillan | F02B 77/02 123/193.6 |
| 2012/0298074 | A1* | 11/2012 | Watanabe | F02B 23/104 123/445 |

* cited by examiner

HIGH EFFICIENCY TWO-STROKE ENGINE

CROSS-REFERENCE TO RELATED APPLICATIONS

This application claims the benefit of U.S. Provisional Patent Application Ser. No. 62/106,335, filed on Jan. 22, 2015, the disclosure of which is hereby incorporated by reference.

TECHNICAL FIELD

The disclosure generally relates to a two-stroke engine.

BACKGROUND

A two-stroke, or two-cycle, engine is a type of internal combustion engine which completes a power cycle in only one crankshaft revolution and with two strokes of a piston. This is accomplished by the end of the combustion stroke and the beginning of the compression stroke happening simultaneously and performing the intake and exhaust functions at the same time. Two-stroke engines often provide high power-to-weight ratio. Two-stroke engines may be either a gasoline, spark ignition engine, or a diesel, compression ignition engine.

SUMMARY

A two-stroke engine is provided. The two-stroke engine includes a crankcase defining a cylinder bore, and a piston moveably disposed within the cylinder bore. A cylinder head is attached to the crankcase and covers the cylinder bore. A wall surface of the cylinder bore, a piston combustion surface of the piston, and a head combustion surface of the cylinder head, cooperate to define a combustion chamber for combusting a fuel therein. A thermal conductivity reducing mechanism is disposed in thermal connectivity with at least one of the crankcase, the piston, and the cylinder head. The thermal conductivity reducing mechanism is operable to reduce heat transfer from combusted fuel within the combustion chamber to at least one of the crankcase, the piston, and the cylinder head.

A cylinder head for a two-stroke engine is also provided. The cylinder head includes a structure having a head combustion surface, and a layer of a low conductivity material disposed on the head combustion surface. The structure is manufactured from a material having a head thermal conductivity, and the layer of low conductivity material includes a thermal conductivity that is less than the head thermal conductivity. The lower thermal conductivity of the layer of low conductivity material reduces an amount of heat otherwise absorbed by the structure from combustion gases.

Accordingly, the thermal conductivity reducing mechanism reduces the amount of heat that one of the crankcase, the piston, or the cylinder head absorbs from combustion gases. The combustion of fuel within the combustion chamber generates large amounts of heat, which may be used to do work. Heat that is absorbed by the various different engine components, e.g., the crankcase, the piston, or the cylinder head, is generally not available to do work, and is therefore lost energy. Accordingly, heat that is absorbed by the various engine components generally reduces the thermal efficiency of the engine. Because the thermal conductivity reducing mechanism reduces the amount of heat that is absorbed by the various components of the engine, more heat energy remains in the combustion chamber to do work, thereby improving the efficiency of the engine.

The above features and advantages and other features and advantages of the present teachings are readily apparent from the following detailed description of the best modes for carrying out the teachings when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Referring to the Figures, wherein like numerals indicate like parts throughout the several views, a two-stroke engine 20 is generally shown at 20. As understood by those skilled in the art, the two-stroke engine 20 is a type of internal combustion engine which completes a power cycle in only one revolution of a crankshaft 22 and with two strokes of a piston 24, i.e., one downward stroke and one upward stroke. This is accomplished by the end of the combustion stroke and the beginning of the compression stroke happening simultaneously and performing the intake and exhaust functions at the same time. The two-stroke engine 20 may be either a gasoline, spark ignition engine, or a diesel, compression ignition engine. The operation of the two-stroke engine 20 is generally understood by those skilled in the art, and is not pertinent to the description of the disclosure. Accordingly, the operation of the two-stroke engine 20 is not specifically described in detail herein.

Figure 1:
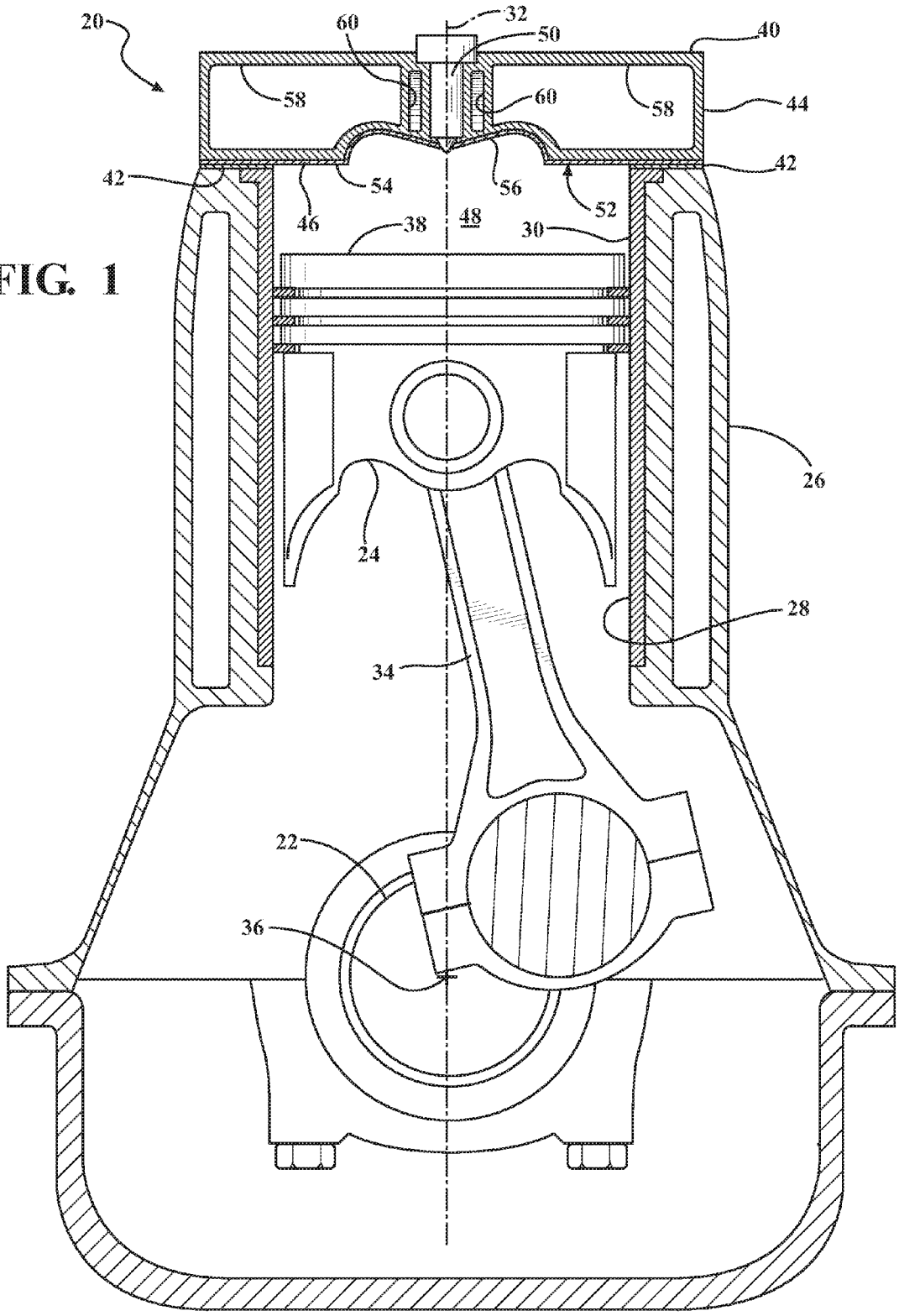
FIG. 1 is a schematic cross sectional view of a two-stroke engine showing a first embodiment of a thermal conductivity reducing mechanism.
Figure 2:
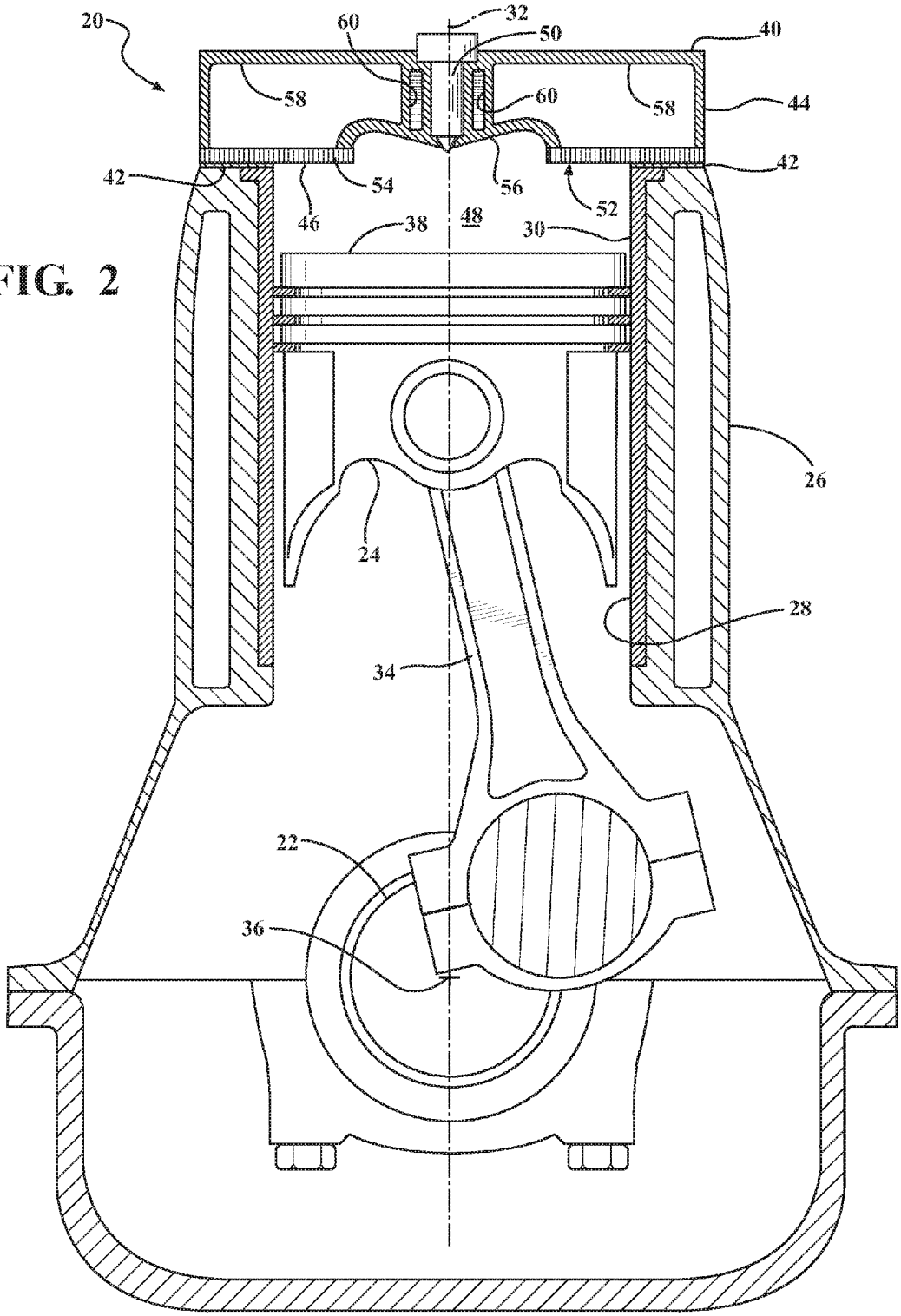
FIG. 2 is a schematic cross sectional view of a two-stroke engine showing a second embodiment of a thermal conductivity reducing mechanism.

Referring to FIGS. 1 and 2, the two-stroke engine 20 includes a crankcase 26. The crankcase 26 defines at least one cylinder bore 28, but may define more than one cylinder bore 28. The cylinder bore 28 is defined by an interior wall surface 30 of the crankcase 26. The cylinder bore 28 extends along a central axis 32, and defines a circular cross section perpendicular to the central axis 32.

Preferably, the crankcase 26 is manufactured from a metal, such as steel or iron. However, it should be appreciated that the crankcase 26 may be manufactured from some other material suitable for use in an internal combustion engine. The material that the crankcase 26 is manufactured from includes a crankcase 26 thermal conductivity. As used herein, thermal conductivity is defined as the property of a material to conduct heat. As is known, the thermal conductivity of any material varies with temperature. Heat transfer occurs at a higher rate across materials of high thermal conductivity than across materials of low thermal conductivity. For example, aluminum may include a thermal conductivity between 205 and 250 Watts per meter per ° Kelvin ($Wm^{-1\circ} K^{-1}$). Accordingly, if the crankcase 26 is manufactured from aluminum, then the crankcase 26 thermal conductivity would be between 205 and 250 $Wm^{-1\circ} K^{-1}$. Steel may include a thermal conductivity between 35 and 54 $Wm^{-1\circ} K^{-1}$. Accordingly, if the crankcase 26 is manufactured from steel, then the crankcase 26 thermal conductivity would be between 35 and 54 $Wm^{-1\circ} K^{-1}$. Iron may include a thermal conductivity between 45 and 80 $Wm^{-1\circ} K^{-1}$. Accordingly, if the crankcase 26 is manufactured from iron, then the crankcase 26 thermal conductivity would be between 45 $Wm^{-1\circ} K^{-1}$ and 80 $Wm^{-1\circ} K^{-1}$. It should be appreciated that the crankcase 26 thermal conductivity will vary, depending upon the specific material used to manufacture the crankcase 26, and as such, the crankcase 26 thermal conductivity may differ from the exemplary embodiments noted above.

The piston 24 is moveably disposed within the cylinder bore 28. As is known, the piston 24 is connected to the crankshaft 22 by a connecting rod 34. Reciprocating movement of the piston 24 along the central axis 32 of the cylinder bore 28 causes rotation of the crankshaft 22 about a crank axis 36. The piston 24 includes a piston combustion surface 38, which is disposed on an upper surface of the piston 24 as viewed on the page of the Figures.

Preferably, the piston 24 is manufactured from a metal, such as steel. However, it should be appreciated that the piston 24 may be manufactured from some other material suitable for use in an internal combustion engine. The material that the piston 24 is manufactured from includes a piston 24 thermal conductivity. For example, as noted above, steel may include a thermal conductivity between 35 and 54 $Wm^{-1\circ} K^{-1}$. Accordingly, if the piston 24 is manufactured from steel, then the piston 24 thermal conductivity would be between 35 and 54 $Wm^{-1\circ} K^{-1}$. It should be appreciated that the piston 24 thermal conductivity will vary, depending upon the specific material used to manufacture the piston 24, and as such, the piston 24 thermal conductivity may differ from the exemplary embodiment noted above.

The two-stroke engine 20 includes a cylinder head 40, which is attached to the crankcase 26 and covers the cylinder bore 28. As is known in the art, the two-stroke engine 20 may include a gasket 42 (e.g., a head gasket 42) disposed between the cylinder head 40 and the crankcase 26 to seal the cylinder bore 28. The cylinder head 40 includes a structure 44 having a head combustion surface 46. The head combustion surface 46 opposes the piston combustion surface 38, and is sized to completely cover the cylinder bore 28. It should be appreciated that the head gasket 42 does not extend across or otherwise cover the head combustion surface 46.

Preferably, the cylinder head 40 is manufactured from a metal, such as steel or iron or aluminum. However, it should be appreciated that the cylinder head 40 may be manufactured from some other material suitable for use in an internal combustion engine. The material that the cylinder head 40 is manufactured from includes a head thermal conductivity. For example, aluminum may include a thermal conductivity between 205 and 250 Watts per meter per ° Kelvin ($Wm^{-1\circ} K^{-1}$). Accordingly, if the cylinder head 40 is manufactured from aluminum, then the head thermal conductivity would be between 205 and 250 $Wm^{-1\circ} K^{-1}$. Steel may include a thermal conductivity between 35 and 54 $Wm^{-1\circ} K^{-1}$. Accordingly, if the cylinder head 40 is manufactured from steel, then the head thermal conductivity would be between 35 and 54 $Wm^{-1\circ} K^{-1}$. Iron may include a thermal conductivity between 45 $Wm^{-1\circ} K^{-1}$ and 80 $Wm^{-1\circ} K^{-1}$. Accordingly, if the cylinder head 40 is manufactured from iron, then the head thermal conductivity would be between 45 and 80 $Wm^{-1\circ} K^{-1}$. It should be appreciated that the head thermal conductivity will vary, depending upon the specific material used to manufacture the cylinder head 40, and as such, the head thermal conductivity may differ from the exemplary embodiments noted above.

The wall surface of the cylinder bore 28, the piston combustion surface 38 of the piston 24, and the head combustion surface 46 of the cylinder head 40 cooperate to define a combustion chamber 48. The two-stroke engine 20 may further include a fuel injector 50 that is supported by the cylinder head 40. The fuel injector 50 is operable to inject fuel into the combustion chamber 48. Preferably, and as known in two-stroke engines 20, the cylinder head 40 may not include any inlet valves or exhaust valves.

As is known in the art, the fuel is compressed as the piston 24 moves upward in the piston 24 stroke. The fuel is ignited or combusted when the piston 24 is near the top of its stroke. Combustion of the fuel releases a large amount of heat, and moves the piston 24 downward in its stroke, which causes rotation of the crankshaft 22 about the crank axis 36. The heat from combustion is either used to do work, e.g., moving the piston 24, is exhausted with the exhaust gas, or is absorbed by one or more of the engine components. If the heat is exhausted with the exhaust gas, then the heat in the exhaust gas may be used to do work at some other location, such as by heating a catalyst in an exhaust gas treatment system, or used for cabin heating. Heat that is absorbed by the various components of the two-stroke engine 20 must be dissipated, and is generally lost and not available to do work, thereby reducing the efficiency of the two-stroke engine 20. Accordingly, limiting or reducing the amount of heat that is absorbed by the various components of the two-stroke engine 20 increases the amount of heat that is available to do work, thereby improving the efficiency of the two-stroke engine 20.

In order to limit or reduce the amount of heat that is absorbed by the various components of the two-stroke engine 20, the two-stroke engine 20 includes a thermal conductivity reducing mechanism 52. The thermal conductivity reducing mechanism 52 is disposed in thermal connectivity with at least one of the crankcase 26, the piston 24, and the cylinder head 40. As used herein, thermal connectivity is defined as a connection or contact between components that allows the transfer of heat therebetween. The thermal conductivity reducing mechanism 52 is operable to reduce heat transfer from combusted fuel within the combustion chamber 48 to at least one of the crankcase 26, the piston 24, and the cylinder head 40. The thermal conductivity reducing mechanism 52 includes a thermal conductivity that is lower than at least one of the crankcase 26 thermal conductivity, the piston 24 thermal conductivity, and/or the head 40 thermal conductivity. Accordingly, the thermal conductivity reducing mechanism 52 acts as an insulator to prevent the absorption of heat. Preferably, the thermal conductivity reducing mechanism 52 includes a thermal conductivity of less than 30 $Wm^{-1}K^{-1}$ (Watts/meter/° K). It should be noted that the thermal conductivity reducing mechanism 52 is not a heat dissipater, but rather, prevents the absorption of heat, i.e., the transfer of heat from the combustion gases to one or more of the engine components.

As shown in FIGS. 1 and 2, the thermal conductivity reducing mechanism 52 may include a layer 54 of a low conductivity material that is disposed on the head combustion surface 46 of the cylinder head 40. As shown in FIG. 1, the layer 54 of low conductivity material extends substantially across the entire head combustion surface 46 and the cylinder bore 28 to form a barrier between the combustion chamber 48 and the head combustion surface 46 of the cylinder head 40. As shown in FIG. 2, the layer 54 of low conductivity material does not extend all the way across the cylinder bore 28, and leaves a combustion bowl portion 56 of the head combustion surface 46 in the cylinder head 40 uncovered. It should be appreciated that the layer 54 of low conductivity material is not a gasket 42, i.e., the layer 54 of low conductivity material is separate from and not part of the head gasket 42 that seals between the cylinder head 40 and the crankcase 26. Additionally, it should be appreciated that the layer 54 of low conductivity material may be disposed on the piston combustion surface 38 of the piston 24, and/or on the wall surface of the cylinder bore 28.

The layer 54 of low conductivity material may include, but is not limited to inconel, nickel alloys, bronze, ceramics, zirconia, composites, or some other similarly capable material. Preferably, the layer 54 of low conductivity material includes a thermal conductivity of less than 30 $Wm^{-1}K^{-1}$ (Watts/meter/° K). However, it should be appreciated that the thermal conductivity of the layer 54 of low conductivity material is dependent upon the specific material used for the layer 54, and may differ from the exemplary value described above.

In addition to, or in lieu of the layer 54 of low conductivity material, the thermal conductivity reducing mechanism 52 may include at least one void 58 defined by one of the components of the two-stroke engine 20. As shown, the void 58 is defined by the structure 44 of the cylinder head 40 and generally disposed over the cylinder bore 28. However, it is contemplated that the void 58 may be defined by the crankcase 26, in a wall adjacent the combustion chamber 48. As shown in FIG. 2, the cylinder head 40 is a composite structure 44, in which the layer 54 of low conductivity material is used to form a bottom wall of the cylinder head 40, to cover and/or complete the formation of the void 58 in the structure 44 of the cylinder head 40, thereby forming a lower wall of the void 58.

Preferably, the at least one void 58 is filled with a gas having a low thermal conductivity. The gas disposed within the void 58 may include, but is not limited to, air, nitrogen, carbon dioxide, or some other similar gas. The gas within the void 58 acts as an insulator to prevent the absorption of heat from the combustion gases, and/or to limit the thermal mass of the cylinder head 40 that is available to absorb heat. As an alternative to the void 58 being filled with a gas, it is contemplated that the void 58 may alternatively be a vacuum. As used herein, the term vacuum is defined as a space that is devoid 58 of matter, or as a region with a gaseous pressure less than atmospheric pressure.

It is also contemplated that the thermal conductivity reducing mechanism 52 is embodied by one or more of the various engine components being completely manufactured from a material having a low thermal conductivity. For example, the entire structure 44 of the cylinder head 40 may be manufactured from a material having a low thermal conductivity, such as but not limited to, inconel, nickel alloys, bronze, ceramics, zirconia, composites, or some other similarly capable material.

As shown in both FIGS. 1 and 2, the cylinder head 40 may optionally include at least one cooling jacket 60 that is disposed adjacent the fuel injector 50. The cooling jacket 60 is operable to circulate a cooling liquid through the cylinder head 40, for cooling the fuel injector 50. The cooling jacket 60 is not operable to significantly cool the cylinder head 40. Furthermore, the cooling jacket 60 is not designed to limit or reduce heat absorption by the cylinder head 40, but rather to dissipate heat from the cylinder head 40 to cool the fuel injector 50. Accordingly, it should be appreciated that the cooling jacket 60 is not part of the thermal conductivity reducing mechanism 52, but is rather a heat dissipation mechanism. The cooling jacket 60 may be part of an engine cooling circuit that circulates a cooling liquid through the engine for cooling the engine, as is known in the art.

The detailed description and the drawings or figures are supportive and descriptive of the disclosure, but the scope of the disclosure is defined solely by the claims. While some of the best modes and other embodiments for carrying out the claimed teachings have been described in detail, various alternative designs and embodiments exist for practicing the disclosure defined in the appended claims.

The invention claimed is:

1. A two-stroke engine comprising:

a crankcase defining a cylinder bore;

a piston moveably disposed within the cylinder bore;

a cylinder head having a structure attached to the crankcase and covering the cylinder bore;

wherein a wall surface of the cylinder bore, a piston combustion surface of the piston, and a head combustion surface of the cylinder head cooperate to define a combustion chamber for combusting a fuel therein; and a thermal conductivity reducing mechanism disposed in thermal connectivity with at least one of the crankcase, the piston, and the cylinder head, and operable to minimize heat transfer from combusted fuel within the combustion chamber to at least one of the crankcase, the piston, and the cylinder head;

wherein the thermal conductivity reducing mechanism includes a layer of a low conductivity material disposed on the head combustion surface of the cylinder head; and wherein the thermal conductivity reducing mechanism includes at least one void defined by the structure of the cylinder head and generally disposed over the cylinder bore;

wherein the at least one void is separate from the layer of the low conductivity material; and and wherein each of the at least one void and the layer of the low conductivity material are operable to insulate against heat absorption.

2. The two-stroke engine set forth in claim 1 wherein the crankcase is manufactured from a material having a crankcase thermal conductivity, the piston is manufactured from a material having a piston thermal conductivity, the cylinder head is manufactured from a material having a head thermal conductivity, with the thermal conductivity reducing mechanism including a thermal conductivity that is lower than at least one of the crankcase thermal conductivity, the piston thermal conductivity, and the head thermal conductivity.

3. The two-stroke engine set forth in claim 1 wherein the layer of low conductivity material is one of an Inconel material, a nickel alloy material, a bronze material, a ceramic material, a zirconia material, or a composite material.

4. The two-stroke engine set forth in claim 1 wherein the layer of low conductivity material exhibits a thermal conductivity of less than 30 $Wm^{-1}K^{-1}$.

5. The two-stroke engine set forth in claim 1 wherein the layer of low conductivity material extends substantially across the cylinder bore to form a barrier between the combustion chamber and the cylinder head.

6. The two-stroke engine set forth in claim 1 wherein the at least one void is filled with a gas.

7. The two-stroke engine set forth in claim 6 wherein the gas disposed within the void is one of air, nitrogen, or carbon dioxide.

8. The two-stroke engine set forth in claim 1 wherein the at least one void is a vacuum.

9. The two-stroke engine set forth in claim 1 further comprising a fuel injector supported by the cylinder head, and operable to inject fuel into the combustion chamber.

10. The two-stroke engine set forth in claim 1 wherein the cylinder head does not include any inlet valves or exhaust valves.

11. The two-stroke engine set forth in claim 1 wherein the cylinder head includes at least one cooling jacket disposed adjacent the fuel injector, and operable to circulate a cooling liquid therethrough for cooling the fuel injector.

12. The two-stroke engine set forth in claim 11 wherein the at least one cooling jacket is not operable to significantly cool the cylinder head.

13. A cylinder head for a two-stroke engine, the cylinder head comprising:

a structure having a head combustion surface;

a layer of a low conductivity material disposed on the head combustion surface;

wherein the structure is manufactured from a material having a head thermal conductivity, and the layer of low conductivity material exhibits a thermal conductivity that is less than the head thermal conductivity to minimize an amount of heat absorbed by the structure from combustion gases;

wherein the structure defines at least one void separate from the layer of the low conductivity material, with the at least one void disposed generally over the head combustion surface and operable to insulate the structure against heat absorption from combustion gases.

14. The cylinder head set forth in claim 13 wherein the layer of low conductivity material exhibits a thermal conductivity of less than 30 $Wm^{-1}K^{-1}$.

15. The cylinder head set forth in claim 13 wherein the head combustion surface is sized to cover a cylinder bore, and wherein the layer of low conductivity material extends substantially across the entire head combustion surface.

16. The cylinder head set forth in claim 13 wherein the at least one void is filled with a gas.

17. The cylinder head set forth in claim 13 wherein the at least one void is a vacuum.

* * * * *